US006095384A

United States Patent [19]

Kim et al.

[11] Patent Number: 6,095,384

[45] Date of Patent: Aug. 1, 2000

[54] GARMENT TOOL FOR EXPANDING SLEEVES AND PANT-LEGS

[76] Inventors: Sang-Jo Kim, 8405 Copperleaf Ct., Fairfax Station, Va. 22039; Chun S. Shin, 8509 Heatherpoint Ct., Springfield, Va. 22152

[21] Appl. No.: 09/094,676

[22] Filed: Jun. 15, 1998

[51] Int. Cl.[7] ..... D06C 15/00

[52] U.S. Cl. ..... 223/74; 223/73

[58] Field of Search ..... 223/63, 65, 61, 223/66, 69, 70, 71, 73, 74, 72, 77, 75, 84

[56] References Cited

U.S. PATENT DOCUMENTS

| | | | |
|---|---|---|---|
| 1,758,742 | 5/1930 | Goldkopf | 223/74 |
| 1,822,281 | 9/1931 | Evanoff | 223/74 |
| 2,948,497 | 8/1960 | Journey | 223/74 |
| 3,015,422 | 1/1962 | DeFino . | |
| 3,333,747 | 8/1967 | Glover, Jr. . | |
| 3,417,905 | 12/1968 | Aloi | 223/74 |
| 3,477,621 | 11/1969 | Forse . | |
| 3,491,927 | 1/1970 | Biel . | |
| 3,726,451 | 4/1973 | Blevens | 223/74 |
| 4,163,331 | 8/1979 | Renaut . | |
| 5,713,822 | 2/1998 | Newman | 482/126 |

*Primary Examiner*—Bibhu Mohanty
*Attorney, Agent, or Firm*—Antonelli, Terry, Stout & Kraus, LLP

[57] ABSTRACT

A garment tool for expanding a garment sleeve or pant-leg for the injection of steam therein, to thereby optimally prepare the garment for the pressing operation associated with the dry-cleaning of garments. The garment tool opens the sleeve or pant-leg of a garment, without excessively stretching the garment sleeve or pant-leg, and traps steam injected therein to prepare the garment for the pressing operation associated with dry-cleaning, without disfiguring the garment in any way.

9 Claims, 2 Drawing Sheets

GARMENT TOOL FOR EXPANDING SLEEVES AND PANT-LEGS

FIELD OF THE INVENTION

The present invention relates to a tool for use in the garment cleaning industry. More particularly, the present invention relates to a garment tool which is used to expand the sleeve or pant-legs of a garment (including blouses, jackets, trousers, etc), for performing the pressing associated with the dry-cleaning of the garment.

BACKGROUND OF THE INVENTION

The process of dry-cleaning garments does not end with the actual dry-cleaning of the garment. That is, after the garment has been dry-cleaned, it must be pressed. Garment pressing is performed by "steaming" the garment so that it can be neatly pressed with minimal wrinkling. To optimally steam a garment's sleeves or pant-legs, steam must be injected and held therein. However, the devices most widely used in the industry fail to hold steam within the sleeves and pant-legs long enough to provide optimum pressing conditions. Furthermore, these devices often serve to mis-shape the garments' sleeves and pant-legs due to the bulkiness of the devices.

Past devices employed for expanding garment sleeves or pant-legs for performing the pressing associated with dry-cleaning of garments include the one depicted in FIG. 1, in which two elongated wooden rods 1 are connected by a spring 2 disposed therein between. To employ the device of FIG. 1 in the steaming operation for a garment, the spring 2 is compressed by forcing the wooden rods 1 towards each other, the device is inserted into the garment sleeve or pant-leg, and then the spring is allowed to expand, thus opening the sleeve or pant-leg to allow steam to pass through. However, this device is disadvantageous in that there is no barrier provided, thereby allowing steam to pass through the sleeve or pant-leg uninhibited. Thus the cleaning/pressing quality of the garment is reduced. Further, the device disfigures garments in which it is utilized since there is no way to contour such a device to accommodate the interior contour of the sleeve or pant-leg, as seen in FIG. 1B.

U.S. Pat. No. 3,015,422 describes a sleeve tool in which one end of two opposing arms are connected by a spring which urges the free ends of the arms apart. The sleeve tool is inserted into the garment sleeve by compressing the spring by forcing the free ends of the arms towards each other. The spring is then allowed to expand once the free ends of the arms are within the sleeve. Excessive expansion of the spring, and the sleeve as well, is prevented by a fabric strap which is attached to the distal ends of each of the free arms. However, because of the shape of the arms, the garment is disfigured. Also, although the strap may absorb a small amount of steam within the sleeve or pant-leg, practical application shows that a mere strip of fabric does not sufficiently impede the loss of steam from the sleeve or pant-leg to provide optimum pressing conditions.

SUMMARY OF THE INVENTION

It is an object of the present invention to provide a garment tool for expanding garment sleeve or pant-legs for the injection of steam therein, to thereby optimally prepare the garment for the pressing operation associated with the dry-cleaning of garments.

Another object of the present invention is to provide a garment tool which opens the sleeves or pant-legs of a garment, without excessively stretching the garment's sleeves or pant-legs, and traps steam injected the sleeves or pant-legs to prepare the garment for the pressing operation associated with dry-cleaning, without disfiguring the garment in any way.

The garment tool of the present invention includes two uniform arms which are pivotally connected at one end by a hinge or spring. A sponge is disposed in between the two arms, towards the distal end thereof. The sponge provides an outward force which biases the distal ends of the arms apart from each other. Therefore, a restraint is disposed at the distal end of the arms to limit the separation of the arms.

The garment tool is able to be compressed to fit within the sleeve or pant-leg of the garment, and is self-supported within the sleeve or pant-leg when the sponge exerts an outward force on the opposing arms against the interior of the sleeve or pant-leg. It is advantageous to utilize the outwardly biasing force of a sponge so as not to apply an excessive force to the arms which could unnecessarily and disadvantageously stretch or deform the sleeve and/or pant-leg. Such deformation of the sleeve/pant-leg is also avoided by crafting the exterior of the opposing arms to have a round or spherical shape, thus accommodating the natural shape of the interior of the sleeve and/or pant-leg. Further still, the size of the arms is interchangeable, depending on the size of the garment and its sleeve/pant-leg.

The garment tool is inserted within the sleeve or pant-leg by compressing the tool, drawing the free ends thereof together. Once the tool is placed inside the sleeve or pant-leg, the sponge is allowed to expand, thus forcing the opposing arms apart, with the exterior of the arms pressed against the interior of the sleeve or pant-leg.

The pressing procedure which follows the dry-cleaning of a garment calls for the interior of the garment to be injected with or exposed to steam. The sponge of the garment tool further serves as a barrier which prevents the steam from quickly exiting the sleeve or pant-leg, thus preparing the garment sleeve and/or pant-leg for quicker, more efficient and more effective pressing.

DETAILED DESCRIPTION OF THE PREFERRED EMBODIMENTS

Figure 2A:
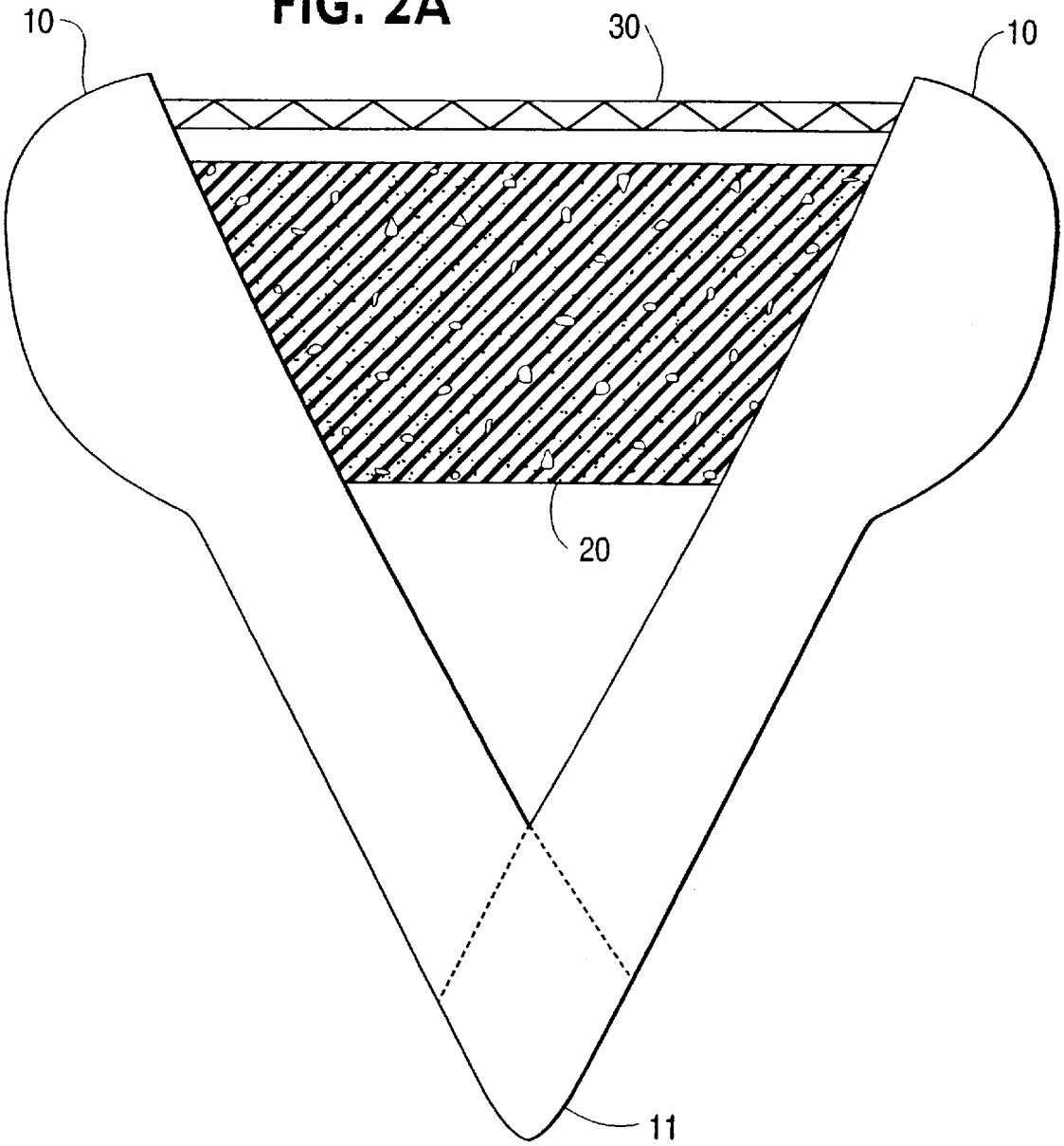
FIG. 2A illustrates the garment tool of the invention.
Figure 2B:
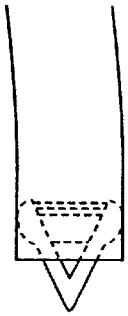
FIG. 2B illustrates an example of a physical application of the invention in a garment sleeve.

A preferred embodiment of the present invention is illustrated in FIG. 2A. Identical arms 10 are pivotally connected at a bottom end thereof by a pivot 11, though a hinge or even a spring device may be used to connect the arms. The arms can be made of any material, including wood, plastic and metal. However, consideration must be given to the fact that use of the garment tool requires constant exposure to steam, and therefore, a material less prone to warping, melting or even rusting is preferred.

The arms 10 are crafted at distal ends thereof to have a rounded exterior. When the garment tool is inserted within the garment sleeve and/or pant-leg, it is the rounded distal ends of the arms that engage with the interior of the sleeve or pant-leg, and the rounded exterior of the arms prevents any deforming of the sleeve or pant-leg.

A sponge 20 is inserted between the free distal ends of the arms 10, biasing the distal ends of the arms 10 apart from each other. A restraint, which can include a chain, string, strap, etc., is attached to the interior of the distal portions of both arms 10.

The garment tool is inserted within the sleeve or pant-leg of a garment by compressing the sponge 20, which requires forcing the distal ends of the arms 10 towards each other. The garment tool is then placed within the interior of the sleeve or pant-leg once the arms 10 are released. Releasing the arms 10 allows the sponge 20 to expand, thus forcing the exterior of the distal ends of the arms 10 against the interior of the sleeve or pant-leg. The biasing force of the sponge forcing the opposing arms 10 away from each other is sufficient for the garment tool to be self-supportive within the sleeve or pant-leg.

Once the garment tool has been inserted with the garment sleeve or pant-leg, the garment is exposed to steam in preparation for the actual pressing of the garment. For optimal pressing, the garment should retain moisture. Thus, unlike the prior art devices, the present invention is able to retain steam for an extended amount of time as the sponge 20 acts as a barrier, substantially completely filling the entire cross-sectional area of the sleeve or pant-leg (or at least a majority of it), thereby "trapping" the steam within the sleeve or pant-leg to prepare the garment for optimal pressing.

Upon completion of the steaming of the garment, the garment tool can be removed from the sleeve or pant-leg by forcing the opposing arms 10 towards each other, thus compressing the sponge 20. Due to the absorbent nature of sponges, the sponge 20 is typically saturated after only a few uses and must be replaced by another sponge on a regular basis. Used sponges may be re-used after being squeeze-dried.

Figure 1A:
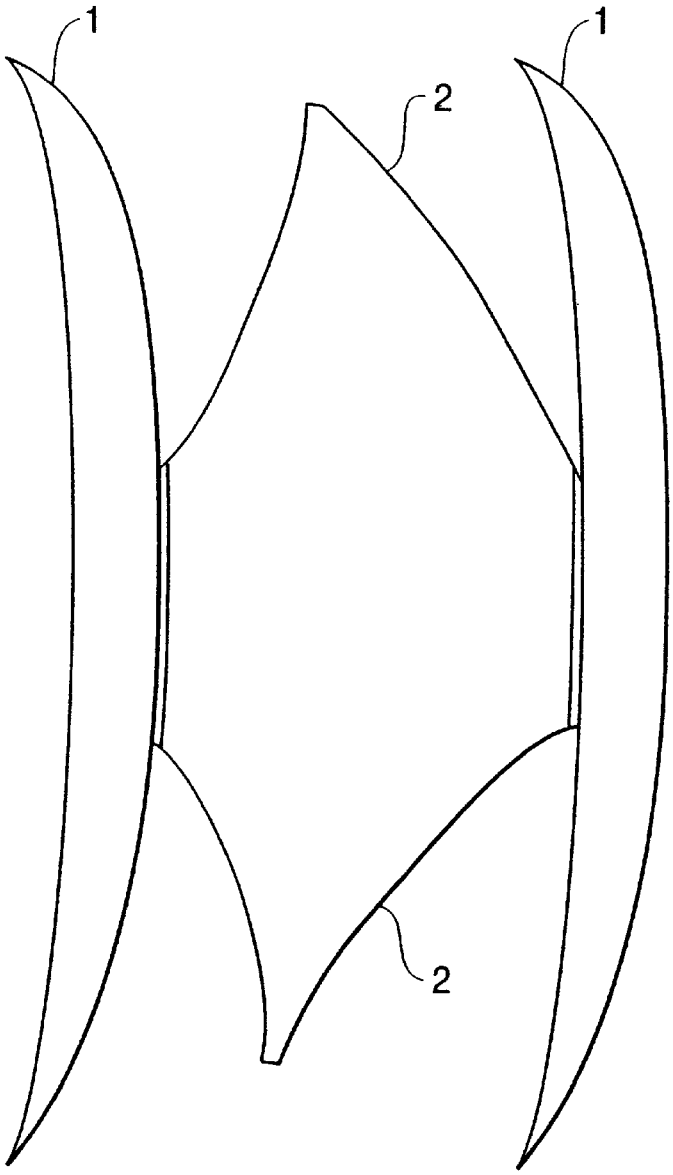
FIG. 1A (PRIOR ART)
FIG. 1A illustrates a prior art device which is most widely used in the industry for "steaming" the sleeves and pant-legs of a garment.
Figure 1B:
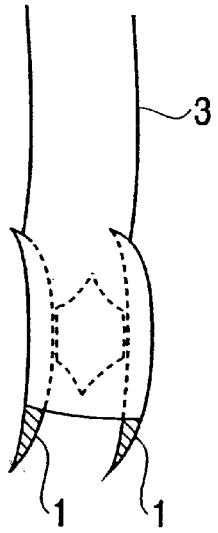
FIG. 1B illustrates the physical application of the prior art device of FIG. 1A in a garment sleeve.

FIG. 1B shows an example of the practical application of the garment tool. The garment tool is inserted into the garment sleeve, for example, without disfiguring the shape of the sleeve. That is, the biasing force applied by the sponge to separate the distal ends of the opposing arms of the garment tool is sufficient to support the garment tool within the sleeve or pant-leg, but is not too strong as to deform the shape of the garment, as is the case illustrated in FIG. 1B.

Lastly, because the sizes of garment sleeves and pant-legs vary, the size of the opposing arms 10 and sponge 20, as well as the length of the restraint 30, can be varied as appropriate. That is, the garment tool of the present invention can easily be varied in size. Also, although the description has primarily focused on the case of the present invention for sleeves and pant-legs, it can be used for other clothing openings, including skirts, waistbands, etc. In addition, use of "sponges" for the present invention can also include any naturally-occurring or man-made steam absorbent element which also has resilient characteristics.

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements including within the spirit and scope of the claims.

What is claimed:

1. A garment tool for expanding clothing openings, comprising:

a pair of uniform arms pivotally connected at a first end thereof;

a sponge for providing an outward force biasing distal ends of said arms apart from each other; and a restraint disposed at a distal end of said arms.

2. A garment tool according to claim 1, wherein said arms are pivotally connected at said first end thereof by a hinge.

3. A garment tool according to claim 1, wherein said arms are pivotally connected at said first end thereof by spring means.

4. A garment tool according to claim 1, wherein said distal ends of said arms retain said sponge as said sponge biases said distal ends of said arms apart from each other.

5. A garment tool according to claim 1, wherein said clothing openings include sleeves and pant-legs.

6. A garment tool according to claim 1, wherein an outer portion of said distal ends of said arms are rounded to fit a contour of a garment sleeve or pant-leg.

7. A garment tool according to claim 1, wherein said sponge further serves as a steam barrier to reduce steam passage from a garment sleeve or pant-leg with which said garment tool is engaged.

8. A garment tool for expanding sleeve and pant-leg openings, comprising:

a pair of uniform arms pivotally connected at a first end thereof;

a sponge for providing an outward force biasing distal ends of said arms apart from each other; and a restraint disposed at a distal end of said arms, wherein said distal ends of said arms retain said sponge as said sponge biases said distal ends of said arms apart from each other, wherein an outer portion of said distal ends of said arms are rounded to fit a contour of a garment sleeve or pant-leg, and wherein said sponge further serves as a steam barrier to reduce steam passage from a garment sleeve or pant-leg with which said garment tool is engaged.

9. A garment tool for expanding sleeve and pant-leg openings, comprising:

a pair of uniform arms pivotally connected at a first end thereof;

a steam absorbent sponge element for blocking a majority of the openings and for providing an outward force biasing distal ends of said arms apart from each other; and a restraint disposed at a distal end of said arms, wherein said distal ends of said arms retain said sponge as said sponge biases said distal ends of said arms apart from each other, wherein an outer portion of said distal ends of said arms are rounded to fit a contour of a garment sleeve or pant-leg, and wherein said sponge further serves as a steam barrier to reduce steam passage from a garment sleeve or pant-leg with which said garment tool is engaged.

* * * * *